United States Patent [19]

Adams et al.

[11] 4,349,745

[45] Sep. 14, 1982

[54] TESTING CIRCUIT FOR FUEL BURNER CONTROLS

[75] Inventors: Keith J. G. Adams, Solihull; Alan Brightwell, Stourbridge; Barry L. Price, Solihull; Stuart M. Pegler, Solihull; Paul Weall, Solihull, all of England

[73] Assignee: British Gas Corporation, London, England

[21] Appl. No.: 240,006

[22] Filed: Mar. 3, 1981

[30] Foreign Application Priority Data

Nov. 6, 1980 [GB] United Kingdom ..... 8035732

[51] Int. Cl.[3] ..... H02J 1/08

[52] U.S. Cl. ..... 307/12; 307/113

[58] Field of Search ..... 307/11, 12, 113

[56] References Cited

U.S. PATENT DOCUMENTS 4,095,123 6/1978 Takahashi ..... 307/113 X

*Primary Examiner*—Michael L. Gellner

*Attorney, Agent, or Firm*—Oblon, Fisher, Spivak, McClelland & Maier

[57] ABSTRACT

A testing circuit for a control system has a two-state input circuit connected across a plurality of switching devices. The input circuit assumes one state when any one of the contacts is closed and the other state when they are all open. An indicator device shows whether the contacts are functioning correctly.

8 Claims, 4 Drawing Figures

TESTING CIRCUIT FOR FUEL BURNER CONTROLS

DESCRIPTION

This invention relates to control systems, and in particular, to fuel burner controls incorporating means for testing components thereof for failure or malfunctioning.

Industrial fuel burners are frequently controlled by an automatic unit which, when there is a demand for heat, takes the burner through a specified light-up sequence and subsequently monitors the burner while it is operating. Typically, the start-up sequence comprise a purge period of perhaps thirty seconds during which air is blown through the burner and combustion space and a start-gas ignition period during which an ignition spark is energised and gas at a low rate is admitted to the burner. Following the start-gas ignition period the ignition spark is extinguished and a flame detector must detect the presence of the flame. After a further period to confirm the stability of the start-gas flame, main gas is admitted to the burner. A typical control unit is powered electrically from the main supply, and controls the ignition source and various gas valves in accordance with the start-up sequence and control logic which includes checks on the combustion air supply, the correct functioning of the flame detector and the like.

It is essential that any fuel burner control be fail-safe in its operation, that is, if any malfunction occurs the ignition source and fuel valves should be de-energised and the system should proceed to a safe condition. Electromechanical relays are customarily used to switch the high voltage supply to the ignition source, valves and other devices rather than a solid state equivalent such as a triac, because of their inherent fail-safe characteristics (i.e. their tendency to fail open rather than closed, with an air-break between the open contacts rather than a high impedance path). Redundant components are usually used to guard against any single component failure, but in order to detect component failure additional self-checking features must be included in the burner controls.

Accordingly the present invention provides a control system comprising a plurality of switching devices connected in parallel with one another across a power supply, each switching device being arranged to connect or disconnect said power supply to one of a corresponding plurality of load devices, a further switching device connected between said plurality of switching devices and their respective load from said power supply and testing means connected between said further switching device and said plurality of switching devices wherein said testing means includes discriminating means for sensing whether the circuit between said plurality of loads and said power supply is complete or open and indicating means for indicating whether the circuit between said plurality of loads and said power supply is complete or open.

Embodiments of the invention will now be described by way of example with reference to the accompanying drawings, in which.

Figure 1:
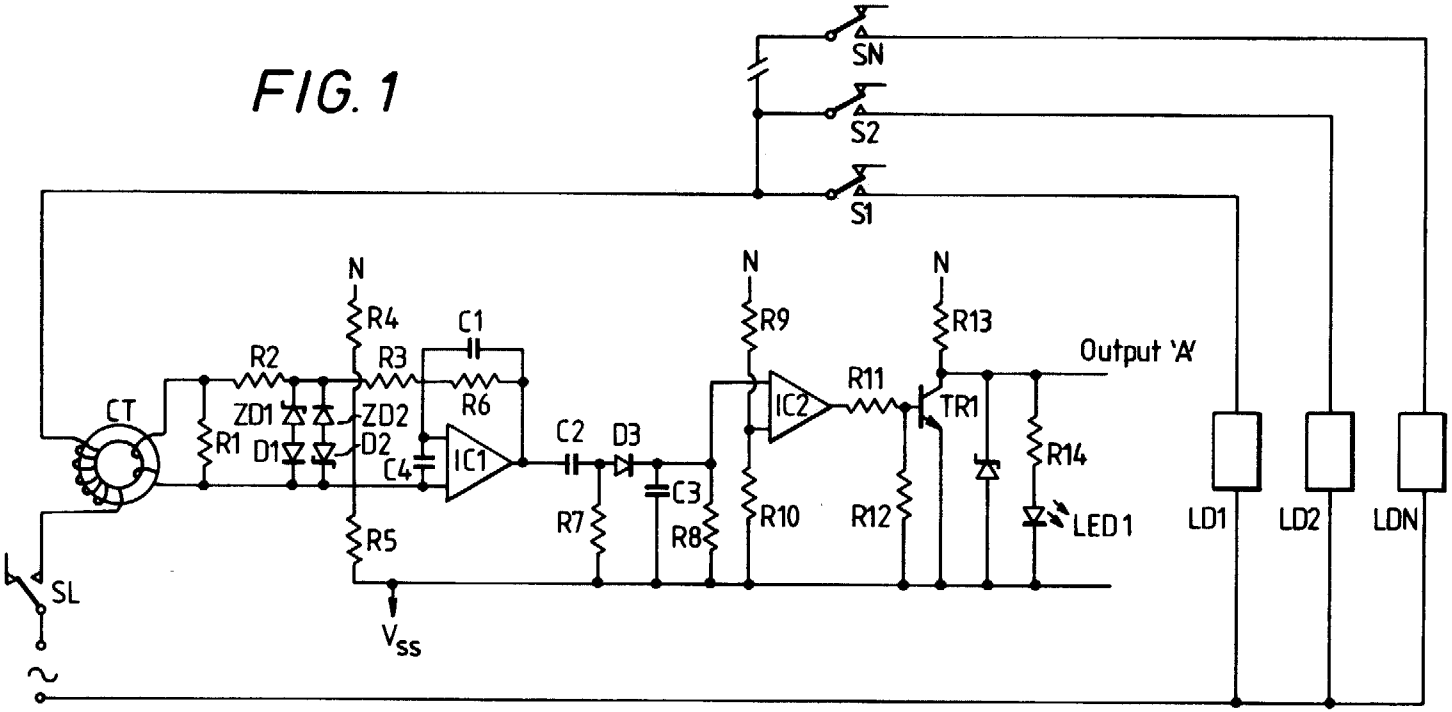
FIG. 1 is a diagram of a part of a fuel burner control circuit incorporating means for testing fuel valve switch contacts.

Referring now to FIG. 1 of the drawings, a fuel burner has a plurality of switch contacts S1, S2, . . . SN controlling a corresponding plurality of loads LD1, LD2, . . . LDN which may be fuel control valves. An additional switch-contact SL is provided in series with the plurality of switch contacts to provide a means of isolating the loads should one of the contacts S1–SN fail in a closed position. The contacts, which are operated by the controller, represent a typical arrangement to sequence the loads to suit the control function. In practice they are likely to be relays.

A current transformer is wired with its primary in series with the output loads LD1–LDN. As the current detector must provide a positive response whenever one or more of these loads is being energised, the range of its dynamic loading may be quite large (say 40:1 in a practical system). To achieve this dynamic range, the current transformer is made to operate in a dual function mode. Connected across the secondary is a resistor R1 in parallel with shunt connected zener diodes ZD1, ZD2 having protection diodes D1, D2 in series therewith. At low values of load current, the transformer secondary voltage is below the zener voltage of the zener diodes and they do not conduct. The effective secondary load comprises the shunt resistor R1 which is chosen to be low in comparison with the current transformer rated load. Under these circumstances, the transformer acts in a voltage mode, like a search coil, and exhibits a high secondary voltage/primary current ratio. In this mode the detector is working at maximum sensitivity. At high load currents the zener diodes are biased at greater than their characteristic voltage and therefore conduct. The effective secondary load is the shunt resistor in parallel with the zener diode limiter resistor R2. This latter is arranged to be equal to the rated current transformer burden and the current transformer operates in the current mode, exhibiting a much lower secondary voltage/primary current ratio.

A differential amplifier IC1 is connected across the zener diodes and is protected against overvoltage by conduction of the diodes. The normal ampere-turn balance on the current transformer prevents the secondary voltage from rising to a value which could damage the current transformer.

The alternating voltage at the input to the differential amplifier IC1 is given a base line of 12 volts by means of a potential divider R4, R5 connected to a stabilised power supply $V_{SS}$. The DC component of the output voltage is blocked by a capacitor C2 and the AC component is fed to a half-wave rectifier D3. The rectifier output is partially smoothed by a parallel filter R8, C3 to give a direct voltage whose level depends on the size of the current transformer primary current and has superimposed on it an associated ripple or sawtooth voltage whose magnitude depends on the filter time constant.

The raw direct voltage is compared with a fixed reference voltage in a second comparator IC2. The reference voltage is set by a potential divider R9, R10 across the stabilised power supply. The comparator output sawtooth voltage is lower or higher than the reference voltage. At very low current transformer currents the sawtooth voltage will always be below the reference voltage and a high comparator output will result, whilst at high currents it will always be above the reference and a low comparator output will result.

The output of the second comparator is inverted by an inverter stage TR1 and a light-emitting diode LED1 provides a visual indication of the state of the circuit. Shunt and feedback capacitors C1, C4 on the first comparator IC1 help to protect the controller against switching transients and a shunt resistors R7 prevents charge build-up on the filter capacitor C3 which would otherwise result from leakage through the blocking capacitor C2.

In operation, to check the isolating switch contact SL any one of the load switches is closed for a short time and the inverter output A monitored to ascertain whether or not it remains high. If the isolating switch contact has failed closed, the inverter output will go low.

To check the load switches S1 to SN the isolating switch SL is closed for a short time and the inverter output A is monitored. The output will go low if any of the switch contacts S1 to SN has failed closed.

To check that the current transformer is operating normally the circuit output is monitored during a normal switching operation.

Figure 2:
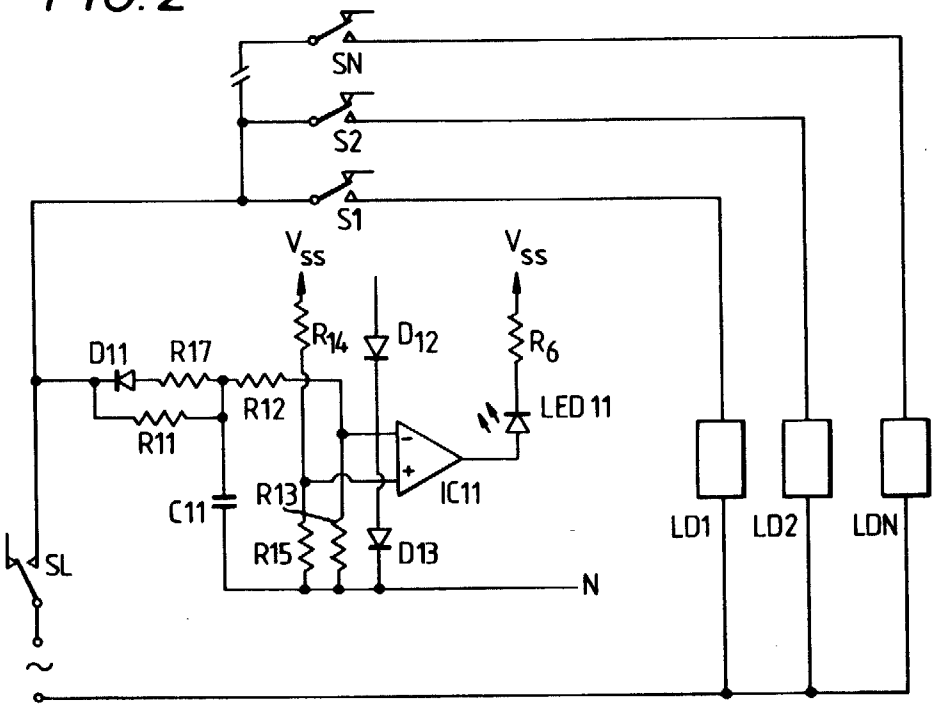
FIG. 2 is a circuit diagram of an alternative arrangement to that of FIG. 1.

An alternative switching contact test circuit is depicted in FIG. 2. As previously a plurality of output loads LD1-LDN is energised by way of switch contacts S1-SN. An isolating switch SL provides safety protection. An operational amplifier IC11 is fed from a stabilised power supply $V_{ss}$. The positive input of the amplifier is held at a fixed reference voltage set by a potential divider R14, R15 connected across the power supply.

A reservoir capacitor C11 is shunted by a potential divider R12, R13 the tapping of which is connected to an input of the operational amplifier. When the isolating switch contact is closed via the burner controller, the capacitor C11 charges to a net voltage set by a diode-resistor chain D11, R17. The resistor serves to limit any current surges due to transient voltages generated by inductive loads. The direct voltage generated across the capacitor C11 forces the negative input of the operational amplifier to a lower potential than that of the positive input via the potential divider R12, R13. Therefore a voltage is developed across the output and a light-emitting diode LED11 provides a visual indication. Diodes D12, D13 on the input serve to clamp the negative input of the operational amplifier to that of the stabilised voltage.

When the isolating switch contact SL is opened, the reservoir capacitor C11 discharges via the shunt divider chain R12, R13 and the input of the operational amplifier. As the capacitor discharges, the potential at the negative input of the operational amplifier rises until it is above that of the positive input. When this point is reached, the output current ceases to flow, switching off the light-emitting diode LED11. Thus, when the switch contact SL is opened, the light emitting diode remains conducting for a period of time set by the time constant C11 (R12+R13). Conveniently, this may be detected by optically coupling it to a phototransistor (not shown).

If any of the load switch contact S1-SN were closed when the isolating switch contact SL was opened, the capacitor C11 would have a different discharge time constant given by $$T = \frac{C11(R12 + R13)\,(R11 + \text{impedance of loads})}{(R11 + R12 + R13 + \text{impedance of loads})}$$

Further, if the impedance (R12+R13) is made much larger than the impedance R11 and the impedance R11 is much larger than the impedance of any of the loads in circuit, then the discharge time constant can be approximated to C11 R11. Thus the capacitor C11 has two possible discharge constants when the isolating switch contacts are opened—C11 R11 when any of the load switch contacts S1-SN are closed and a longer time constant C11 (R12+R13) when all the switch contacts remain open.

A typical procedure for checking the position of the switch contacts would be to close the isolating switch contact SL for a short period of time (say 20 mS) until the light-emitting diode conducts then open the isolating switch contact and monitor the light-emitting diode. If it remains conducting the switch contact has failed to open. If the diode remains conducting for a short period of time charactised by the time constant C11 R11 one of the load switch contacts has failed to open. If the light-emitting diode remains conducting for a longer period of time characterised by the time constant C11 (R12+R13) all the switch contacts have opened. The time constant ratio (R12+R13)/R11 should typically be of the order of ten for good discrimination.

Figure 3:
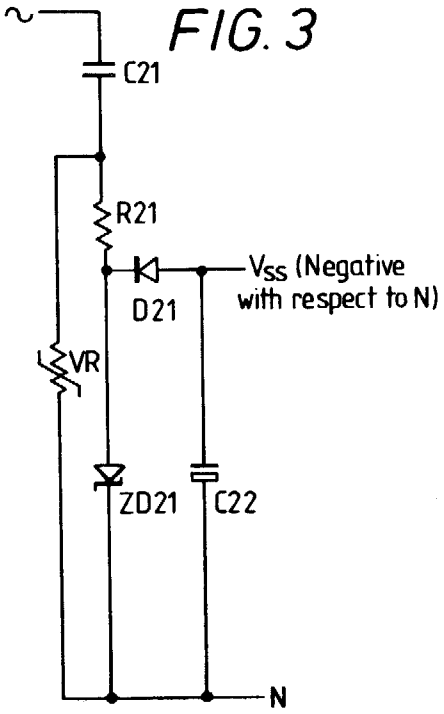
FIG. 3 illustrates a power supply suitable for the controller circuits of FIGS. 1 and 2. The power supply generates a supply voltage $V_{SS}$ which is negative with respect to N.
Figure 4:
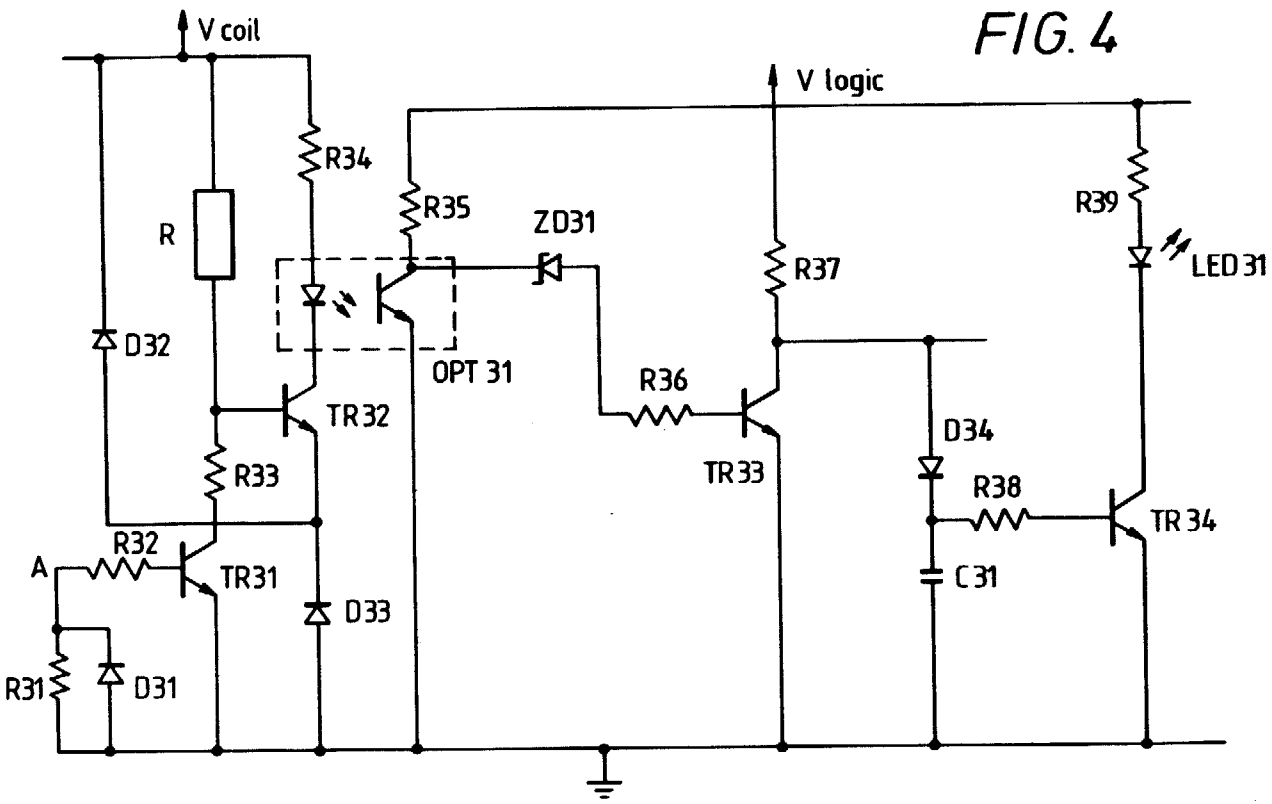
FIG. 4 is a diagram of a circuit for checking the operation of relays incorporated in the circuits of FIGS. 1 and 2.

A suitable power supply for the checking circuit of FIGS. 1 and 2 is shown in FIG. 3. Alternating current from the mains supply is fed through a series capacitor C21 and limiter resistor R21 which, together with a shunt voltage dependent resistor VR, limit any current surges due to transient voltage induced by inductive loads. The supply voltage, the $V_{SS}$ is set by a zener diode ZD21 and a half-wave rectifier D21 feeds a reservoir capacitor C22. The voltage $V_{SS}$ is negative with respect to N. With the circuits of the type shown in FIGS. 1 and 2 employing relays as the switching devices, it is desirable to be able to check that the energisation circuits (coil continuity) will operate without actually performing the relay switching operation. A suitable circuit to perform this function is shown in FIG. 4. Basically, the technique involves the rapid pulsing of the relay coil and the subsequent monitoring of the coil load current before the relay has had time to respond to the pulse and switch on its own load. In the case of a magnetic remanence latching relay, the energising pulse is required to be considerably shorter than that required to switch the relay, to avoid gradual demagnetization of the core. If the coil current is detected, then it has responsed to the pulse and the energisation circuit is deemed to be operating satisfactorily.

An energisation pulse is applied at the input A of a relay driving circuit R31, R32, D31, TR31, R33. Provided the relay driving circuit and the load coil are continuous, a current detector TR32 will switch as soon as the current through the relay load resistor exceeds a threshold value sufficient to exceed the base-emitter knee voltage. The drive circuit is now operating in its normal mode, but the length of pulse is chosen so as not to energise the relay sufficiently to cause switching to take place or cause demagnetization of the core in the case of a magnetic remanence latching relay.

Current flow in the current detector transistor TR32 results in switching on of an opto-isolator OPT31 which bypasses the base of a switching transistor TR33, causing its collector to go high. This high state exists for some tens of microseconds longer than the input pulse due to the slow switch-off mode of the opto-isolator. The switching transistor TR33 feeds a charge storage circuit D34, C31, R38, TR34 which drives a light-emitting diode LED 31 for a considerable time after the cessation of the high input signal, permitting a display to be observed when input pulses are present. The sensitivity of the circuit is determined by the relay load resistor R33.

A typical procedure for checking the energisation circuit of a relay is to provide a short pulse or series of pulses, typically 20 μS long, at the input whilst monitoring the output to confirm that a change in level occurs.

The systems described are particularly suitable for computer or microprocessor-based control systems but are not limited to such applications.

We claim:

1. A control system comprising a plurality of switching devices connected in parallel with one another across a power supply, each switching device being arranged to connect or disconnect said power supply to one of a corresponding plurality of load devices, a further switching device connected between said plurality of switching devices and said power supply to isolate said switching devices and their respective load from said power supply and testing means connected between said further switching device and said plurality of switching devices wherein said testing means includes discriminating means for sensing whether the circuit between said plurality of loads and said power supply is complete or open and indicating means for indicating whether the circuit between said plurality of loads and said power supply is complete or open.

2. A control system as claimed in claim 1 wherein said testing means includes current transformer means having a primary winding in series with said plurality of switching devices and said further switching device.

3. A control system as claimed in claim 2 wherein the secondary winding of said current transformer means is coupled to a two-state load circuit which presents a relatively high impedance at a first secondary current level and a relatively low impedance at a second secondary current level.

4. A control system as claimed in claim 3 wherein the two-state load circuit includes zener diode means which presents a relatively high impedance at a first secondary current level and a relatively low impedance at a second secondary current level.

5. A control system as claimed in claim 1 wherein said testing means includes voltage comparator switching means having an input circuit which has a first discharge time constant when any one of the plurality of switching contacts is closed and a second time constant when each of said plurality of switching contacts is open.

6. A control system as claimed in any one of the preceding claims wherein said testing means includes a stabilised power supply derived from the power supply to said plurality of switching devices.

7. A control system as claimed in any one of the preceding claims including relay coil continuity testing means comprising pulse source means connected to said relay coil to apply to said coil a first pulse of insufficient duration to cause the switch contacts associated with said relay coil to close, resistive load means in series with said coil, switching means coupled to said resistive load means to generate a second pulse of greater duration than said first pulse when triggered by said first pulse and indicator means coupled to said switching means to provide an indication of the incidence of said pulse.

8. A burner control system as claimed in claim 7 wherein the relay coil comprises a magnetically latching relay and the pulse duration is insufficient to significantly demagnetise the latching means.

* * * * *